United States Patent [19]

Johnson

[11] 3,930,988

[45] Jan. 6, 1976

[54] RECLAIMING USED MOTOR OIL

[75] Inventor: Marvin M. Johnson, Bartlesville, Okla.

[73] Assignee: Phillips Petroleum Company, Bartlesville, Okla.

[22] Filed: Feb. 24, 1975

[21] Appl. No.: 552,287

[52] U.S. Cl. ..... 208/182; 208/89; 208/254; 208/236; 208/289; 208/182; 208/299

[51] Int. Cl.[2] ..... C10M 11/00; C10G 17/00

[58] Field of Search ..... 208/182, 181, 179, 183, 208/299, 310, 289, 253, 184, 89

[56] References Cited

UNITED STATES PATENTS

| | | | |
|---|---|---|---|
| 1,828,429 | 10/1928 | Moreton | 208/183 |
| 3,169,917 | 2/1965 | Kahan | 208/180 |
| 3,294,678 | 12/1966 | Gleim | 208/309 |
| 3,791,965 | 2/1974 | Fitzsimons et al. | 208/183 |
| 3,817,855 | 6/1974 | Smith et al. | 208/212 |
| 3,879,282 | 4/1975 | Johnson | 208/251 |

FOREIGN PATENTS OR APPLICATIONS

| | | | |
|---|---|---|---|
| 2,030,609 | 9/1969 | Germany | 208/181 |

OTHER PUBLICATIONS

"Reclamation of Gasoline Used in Dry Cleaning," Department of Commerce Technologic Papers of the Bureau of Standard No. 280, Part of Vol. 18, 122.

*Primary Examiner*—Delbert E. Gantz
*Assistant Examiner*—Juanita D. M. Nelson

[57] ABSTRACT

A process for reducing the ash content and the content of metals present in used motor oils by contacting the used motor oil with an aqueous solution of ammonium sulfate and/or ammonium bisulfate under conditions to react with the metal compounds present to form separable solids. In another embodiment of the invention, the used motor oil after reaction with an aqueous solution of ammonium sulfate and/or ammonium bisulfate can be further treated with an adsorbent and then optionally hydrotreated to produce an oil product suitable as a fuel or as a feedstock for lubricating oil compositions.

12 Claims, 1 Drawing Figure

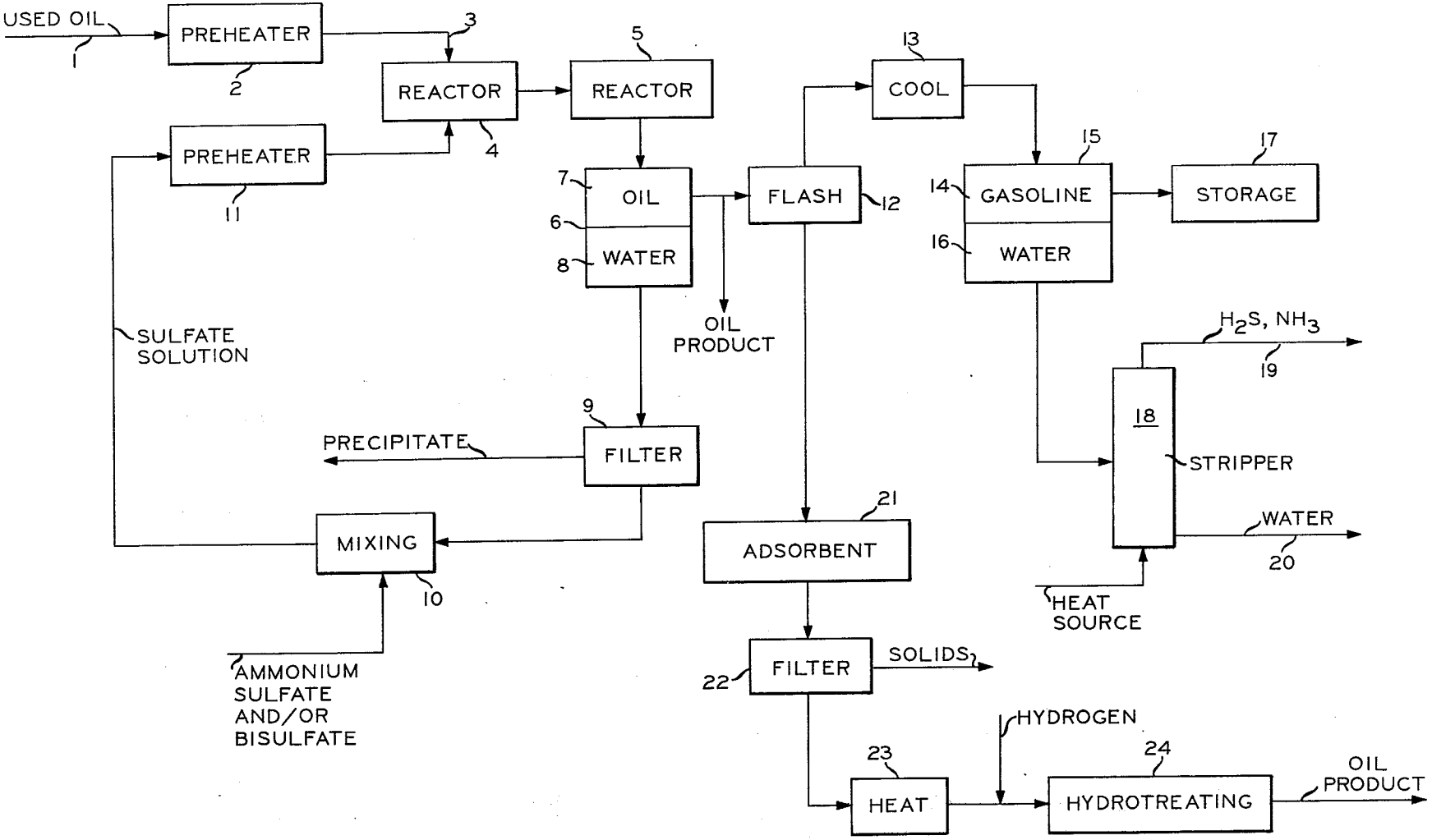
USED OIL
1
PREHEATER
2
3
REACTOR
4
REACTOR
5
OIL
6
WATER
7
8
OIL PRODUCT
FLASH
12
COOL
13
GASOLINE
14
WATER
16
15
STORAGE
17
$H_2S$, $NH_3$
19
STRIPPER
18
WATER
20
HEAT SOURCE
PREHEATER
11
SULFATE SOLUTION
FILTER
9
PRECIPITATE
MIXING
10
AMMONIUM SULFATE AND/OR BISULFATE
ADSORBENT
21
FILTER
22
SOLIDS
HEAT
23
HYDROGEN
HYDROTREATING
24
OIL PRODUCT

RECLAIMING USED MOTOR OIL

This invention relates to treatment of motor oils. In accordance with another aspect, this invention relates to the removal of impurities present in used motor oils by treatment with an aqueous solution of ammonium sulfate and/or ammonium bisulfate. In accordance with another aspect, this invention relates to an ecological process for removing contaminants from used motor oils comprising reacting used motor oils with an aqueous solution of ammonium sulfate and/or ammonium bisulfate and, optionally, further treating the thus-treated motor oil under hydrogenation conditions to remove additional contaminants and produce a marketable low-ash oil product. In still another aspect of the invention, it relates to the removal and separation of such specific contaminants as gasoline, metal salts, tetraethyllead, ammonia, hydrogen sulfide, and the like from used motor oils by treatment with aqueous ammonium sulfate and/or ammonium bisulfate and hydrotreating.

Broadly, this invention relates to the reduction of removal of contaminants from used motor oils by a series of treatments of the motor oil, the treating reagent, and product streams so that all process streams are either recycled or can be removed under conditions to avoid contamination of the environment.

Most used motor oil collected at service stations is now disposed of as a marginal furnace oil, used on rural dirt roads for dust control, or dumped as a major source of hydrocarbon pollution in sanitary sewers and land fills. Less than ten percent of the available one billion gallons per year of used oil is reprocessed for use as a cheap lubricant. Disposal as a fuel oil gives rise to serious atmospheric pollution problems from combustion of a fuel containing in excess of one percent lead, and higher burner and refractory maintenace costs offset the purchase price differential between used oil and regular furnace oil.

It is virtually certain that some regulation on the amount of lead in fuel oil will curtail the disposal of used motor oil in the near future. Regulations preventing the dumping of used oil into sanitary sewers or storm drains exist in many cities and are being contemplated in many states. Most existing reclaiming plants for re-refining of oil use sulfuric acid to coagulate as an acid sludge the ash and polar components in used oil. This, followed by treatment with alkaline solutions to neutralize the acid, water washing, active clay decolorizing, stripping, and filtration yields a lube stock suited to reuse as a low grade motor oil or as a grease base. The poor yield of re-refined oil and the environmental problems of disposal of acid sludge and clay make this reclaiming process a marginal operation at best. It is generally agreed that a real problem exists, none of the current disposal methods are satisfactory, and the only reason that legislation restricting the disposal of used oil by current methods has not been passed is that better solutions to the problem are not available.

Recently, several improved processes for reclaiming used oil have been proposed. Propane extraction prior to acid treatment reduces the amount of acid and clay required, but the yield of recovered oils remains at 65 percent and plant investment costs are much higher. Vacuum distillation has been suggested, and work has been done on hydrotreating of the distilled oil to lube stock. This latter process leaves a high ash residue, and serious problems in fouling of heat exchanger and fractionation equipment have been encountered. The heavy oil containing the ash remains to be disposed of by a satisfactory manner, not disclosed.

The ideal solution to the disposal problem would be the removal of the ash components from the used oil as a solid for recovery of the lead at a smelter with reuse of the ash-free oil as a low sulfur fuel oil or conversion back to a lube stock by hydrotreating to remove oxygen, sulfur, and nitrogen compounds. Reuse of the hydrotreated product as a lube stock would reduce the critical shortage that now exists for this product, and the premium price commanded would offset the processing and collection costs that accompany the conversion of a nuisance-disposal problem to a useful marketable product.

In view of the increasing concern regarding conservation of our petroleum reserves and the best use of products derived from them, this invention is of timely significance. Oil purified by the practice of this invention can be used as a burning oil substantially free of the harmful lead and other additives of modern lubricating oils. Thus, atmospheric pollution is reduced by utilizing the purified oil as a burning stock. Conservation is achieved by reuse of the oil that would otherwise be discarded. The purified oil now free of metal contaminants can be reprocessed by means of conventional hydrotreating processes to yield a high grade lubricating oil-based stock that can be recompounded to give high grade lubricating oil. Alternately, the purified oil can be used for road oil or heating oil, if desired.

The process by which the used motor oil is purified is also designed to recirculate the processed material and to remove compounds potentially hazardous to the environment in such a way that no ecological problem is produced.

Accordingly, an object of this invention is the treatment of many different oils containing contaminating impurities in order to remove these impurities by a simple process.

A further object of the invention is to provide a method for separating and removing contaminants from many types of contaminated oils.

It is a further object of the invention to provide a process for reducing the ash content and the lead content of used motor oils.

It is another object of this invention to provide a method for treating used motor oils so that metal salts, tetraethyllead, gasoline, ammonia, hydrogen sulfide, and the like that can be removed of this invention are handled in such a manner that ecological hazards can be avoided.

Other aspects, objects, and the several advantages of the invention will be apparent to one skilled in the art upon studying this specification, drawing, and the appended claims.

In accordance with the invention, a process is provided for reducing the ash content of used lubricating oils which comprises contacting the used lubricating oil with an aqueous solution of ammonium sulfate and/or ammonium bisulfate under conditions that will react the sulfate or bisulfate compound with metal-containing compounds present in the used lubricating oil which conditions are sufficient to form a precipitate of contaminants in the oil thus treated. Following contacting of the used lubricating oil with ammonium sulfate and/or ammonium bisulfate, the reaction mass is allowed to gravity separate into an oil phase and an aqueous phase which contains the precipitate of contaminants, thereby leaving an oil phase substantially reduced in ash-producing contaminants.

Similarly, the instant process reduces the lead content of the used lubricating oil by reaction of the lead salts with ammonium sulfate and/or ammonium bisulfate to produce lead compounds that will precipitate from the reaction solution.

The treated oil product separated following contacting of the used lubricating oil with an aqueous solution of ammonium sulfate and/or ammonium bisulfate results in marketable low-ash product useful as a low sulfur furnace oil.

In another embodiment of the invention the oil phase recovered following contacting of the used lubricating oil with an aqueous ammonium sulfate and/or ammonium bisulfate solution is further treated by contacting with a solid absorbent to remove polar compounds remaining in the treated used lubricating oil and then subjecting the used oil reduced in polar compounds to hydrotreating to remove residual polar compounds and unsaturated materials and produce an oil product suitable for use as a fuel or as a feedstock for lubricating oil composition.

Further, in accordance with the invention, an integrated process is provided in which used lubricating oils are heated and intermixed in a reaction zone with a heated aqueous solution of an ammonium sulfate and/or bisulfate to produce precipitable metal compounds. These metal compounds precipitate from the hot reaction mixture and are allowed to settle in the water layer as the oil and water separate into separate layers. The water layer can then be filtered to remove the precipitate and ammonium sulfate and/or ammonium bisulfate is added to the filtered water and recirculated through a heater to the reaction zone for reuse in the process. The oil layer can be recovered as such for use as a marketable low-ash oil useful as a furnace oil. However, in a preferred embodiment, the oil layer is flashed to remove gasoline and water that are present in the oil, and the flashed mixture is cooled and allowed to separate into a gasoline layer and a water layer. The gasoline layer can be withdrawn and passed to storage, and the water layer is passed to a stripping zone for recovery of ammonia and $H_2S$ overhead and a purified water stream as bottoms. The stripped water can be recycled to the reaction zone for reuse or discarded as desired. The flashed oil can then be passed through an absorption zone to remove polar compounds and then subjected to hydrotreating to further reduce residual polar compounds and unsaturates present in the lubricating oil and then recovered as a marketable product which can be reused as a lube stock.

The expression, "used lubricating oil," relates to engine and industrial lubricating oils which due to their use do not comply with their original composition. Chemical analysis of used lubricating oil shows that the principal metallic substituents present in these oils are lead, calcium, and barium with lesser amounts of zinc, cadmium, copper, and silver.

The basis for the recovery process of this invention is the discovery that ammonium sulfate and/or ammonium bisulfate are particularly suitable for reacting with metal contaminants usually contained in used lubricating oils to produce insoluble solids that will precipitate or separate from the oil. It is presently preferred for best results to use either ammonium bisulfate or about an equal molar mixture of ammonium bisulfate and ammonium sulfate. The concentration of ammonium sulfate and/or ammonium bisulfate in the aqueous solution can vary appreciably but will generally range from about 2 to about 25 weight percent. On a practical basis, it has been found that a concentration of the sulfate in aqueous solution of about 5 to about 15 weight percent is preferred.

The conditions used in carrying out the initial contacting of used lubricating oil with an aqueous solution of the sulfate can vary appreciably and will be sufficient to cause a reaction between the metal contaminants present in the oil with the sulfates to produce precipitable solids containing the contaminating material. Thus, the reaction pressure can vary from about atmospheric to about 750 psig, with a preferred reaction pressure of about 90 to about 350 psig. However, the reaction of the invention will take place by contact of the used lubricating oil and the ammonium sulfate at about atmospheric pressure. Similarly, the temperatures suitable for carrying out the reaction can vary from about 200°F (93°C) to about 500°F (260°C), but for practical considerations a preferable temperature range is from about 320°F (160°C) to about 430°F (221°C).

The used motor oils treated by the process of this invention are primarily the discared oils that have been used for automotive lubrication purposes such as crankcase oils, transmission and gear oils, and the like. Other sources of used oils include steam-turbine oils, steam-engine oils, hydraulic oils, heat-transfer oils, cutting oils, and the like.

The oils used for the purposes named above are the refined lubricating cuts from paraffin-base, mixed-base, or naphthenic crudes. Their viscosities are generally in the range of from about 100 to 1800 SUS at 100°F (37.8°C). The oils also contain various additives such as oxidation inhibitors (i.e., barium, calcium, and zinc alkyl thiophosphates, di-t-butyl-p-cresol, etc.), antiwear agents (i.e., organic lead compounds such as lead diorganophosphorodithioates, zinc dialkyldithiophosphates, etc.), dispersants (i.e., calcium and barium sulfonates and phenoxides, etc.), rust inhibitors (i.e., calcium and sodium sulfonates, etc.), viscosity index improvers, (i.e., polyisobutylenes, poly-alkylstyrenes, etc.), detergents (i.e., calcium and barium salts of alkyl benzene sulfonic acids and ashless type detergents such as alkyl-substituted succinimides, etc.).

Synthetic oils such as the diesters derived from adipic, azelaic, or sebacic acids esterified with $C_8$ to $C_9$ branched-chain alcohols used for lubricating purposes exemplified by di(2-ethylhexyl) sebacate, di(3,5,5-trimethylhexyl) adipate, di(3,7-dimethyloctyl) azelate, and the like can also be reclaimed by the process of the invention using the milder conditions to avoid degradation of the oils by hydrolysis.

As indicated above, the treated used lubricating oil can be further treated with an absorbent to remove polar compounds present in the used lubricating oil to further refine the oil product. The treated oil can be contacted with a suitable absorbent under conditions sufficient to effectively remove polar compounds which can include oxygen-, nitrogen-, and sulfur-containing compounds, as well as other polar materials. The conditions of contacting with an absorbent will generally be in the range of 0 to 1000 psig and a temperature of 300°F to 760°F (149°–404°C). Suitable absorbent include at least one of activated clay, silica gel, alumina, and the like.

Also as indicated previously, following contacting of the oil with an absorbent, the treated used lubricating oil can be further subjected to hydrotreating to remove residual polar compounds and unsaturated compounds to obtain a final product suitable for use as a fuel or as a feedstock for lubricating oil compositions. The conditions for hydrotreating are well known in the art and include temperatures in the range of 500°F to 800°F (260°–427°C) and pressures in the range of 150 to 3000 psig in the presence of sufficient hydrogen to effectively remove the undersirable constituents present in the oil. Further hydrotreating conditions include a space velocity of 0.2 to 5 LHSV and a hydrogen concentration of 500–2500 $ft^3$/bbl of feed. Suitable hydrogenation catalysts include nickel-molybdenum sulfide on alumina, cobalt molybdate, tungsten-nickel sulfide on alumina, and the like.

The instant process can be carried out in a batch, semi-continuous, or continuous manner. The embodiment of the invention representing an integrated ecological system of treating used lubricating oil can best be understood in conjunction with the drawing which illustrates in schematic form a process for treating used lubricating oils together with recycle or recovery of various treating and treated components.

Referring now to the drawing, used oil can be passed through line 1 to a preheater 2 where the temperature is raised from about 200°F (93°C) to about 500°F (260°C) and in one embodiment from about 320°F (160°C) to about 430°F (221°C). Ther preheated oil is passed through line 3 into the first of a series of stirred reactors 4 where it is contacted with an aqueous solution of ammonium sulfate and/or ammonium bisulfate which has been pre-heated to a temperature in the same range. The pressure in the reactors and in the oil-water separator is sufficient to maintain the reaction mixture substantially completely in the liquid phase. In the reactor, the mixture is agitated vigorously. The reaction mixture can then be passed to another stirred reactor 5 where the same reaction conditions and agitation are maintained.

The reaction mixture is passed to a phase separator 6 in which the oil layer 7 and the water layer 8 are allowed to separate. During this separation precipitated metal salts rapidly settle into the water layer.

The water layer with precipitate is passed through a filter 9 where the precipitate is removed and discarded or processed to recover the metal or metals contained therein. The filtered water is then admixed with ammonium sulfate and/or ammonium bisulfate in 10 to bring the concentration of ammonium sulfate and/or ammonium bisulfate into the range of about 5 to about 15 weight percent and recycled to a preheater 11 where the temperature is raised within the reaction range and the material passed back to reactor 4. By maintaining the phase separation, filtering of the water, and the addition of ammonium sulfate and/or ammonium bisulfate at temperatures somewhat reduced from the reaction temperature, the filtering operation and the dissolving of the ammonium sulfate and/or ammonium bisulfate are facilitated and a minimum of preheat is required in preheater 11. Heating or cooling are adjusted as required to meet these objectives.

The oil layer 7 from phase separator 6 is passed either to a water wash to remove small amounts of ammonium sulfate from the treated oil to yield a low ash product suited to use as a low sulfur fuel oil or into a flash chamber 12 where the pressure is reduced to atmospheric or slightly above and the gasoline and water present in the oil are flashed to a vapor. This vapor is then cooled in a cooler 13 to a temperature sufficiently low to condense the gasoline and water at the pressure in the vessels. Cooled liquid is passed to a phase separator 15 where a gasoline layer 14 and a water layer 16 are allowed to form. The gasoline layer can then be transferred to storage 17 and the water layer 16 can be passed to a stripping operation 18 operated at conditions, such as temperature, pressure, flow rate, etc., well known in the art, sufficient to remove ammonia and hydrogen sulfide as overhead product 19. These products can then be recovered or suitably disposed.

The stripped water 20 from the stripper 18 can then be recycled for use in the aqueous ammonium sulfate system or, at this point in the operation, is sufficiently free from harmful contaminants to be discarded into the environment. Any convenient heat source such as hot flue gases from the preheaters can be used for operating the stripping system.

The oil layer 7 which has been flashed is passed, while still close to reaction temperature, through an absorbent bed 21 at a temperature above 350°F (177°C) to remove polar compounds such as oxygen-, nitrogen-, and sulfur-containing compounds therefrom and then through a filter 22 to remove extraneous matter. The treated oil is then heated in heat exchanger 23, hydrogen is admitted, and the mixture is passed to hydrotreating unit 24 wherein the treated oil is subjected to hydrogenation conditions in the presence of a catalyst sufficient to remove residual polar compounds and unsaturated materials to yield an oil product that has utility as a lube stock.

The following example is offered as an illustration of the effectiveness of ammonium sulfate reagents in reducing the ash content and inorganic lead content of used motor oil.

EXAMPLE

A series of runs were carried out for the treatment of used motor oil having a sulfated ash content of 2.46 weight percent and a lead content of 1.15 weight percent with ammonium sulfate, ammonium bisulfate, and a mixture of ammonium sulfate and ammonium bisulfate under conditions to precipitate metal contaminants as solids. The used motor oil and an aqueous solution of the sulfate reagent were mixed in an autoclave, heated to the reaction temperature, and allowed to react until a substantial portion of the metal contaminants present in the lubricating oil were formed into precipitatable solids. In one run to simulate a continuous process, used oil and reagent were added to a stirred reactor at rates shown in Table I.

The conditions of the various runs, reagents, and concentrations of the reagents, and the results of the runs are set forth in Table I.

TABLE I

ASH REMOVAL WITH SULFATE REAGENTS

| Reagent | Oil, ml | Reagent, Grams | $H_2O$, Grams | Temp., °F—°C | Time, min. | Ash Content, Wt. % | Pb Content, Wt. % |
|---|---|---|---|---|---|---|---|
| $(NH_4)_2SO_4$ | 300 | 20 | 100 | 370–188 | 60 | .43 | .20 |

TABLE I-continued

| Reagent | Oil, ml | Reagent, Grams | $H_2O$, Grams | Temp., °F—°C | Time, min. | Ash Content, Wt. % | Pb Content, Wt. % |
|---|---|---|---|---|---|---|---|
| ASH REMOVAL WITH SULFATE REAGENTS | | | | | | | |
| $(NH_4)_{1.5}$ $H_{0.5}$ $SO_4$ | 300 | 20 | 100 | 370–188 | 60 | .08 | .008 |
| $(NH_4)_1H$ $SO_4$ | 300 | 20 | 100 | 375–190.5 | 60 | .09 | .014 |
| | 600 | 20 | 100 | 375–190.5 | 60 | .10 | .005 |
| | 600 | 20 | 50 | 375–190.5 | 60 | .09 | .008 |
| | 300 | 20 | 100 | 385–196 | 30 | .13 | .014 |
| | 600 | 20 | 100 | 380–193 | 30 | .10 | .009 |
| | 600 | 20 | 50 | 375–190.5 | 30 | .12 | .007 |
| | 300 | 20 | 100 | 300–149 | 60 | .22 | .014 |
| | 300 | 20 | 100 | 250–121 | 60 | .19 | .051 |
| Well-Stirred Tank (Continuous) | ml/Hr | g/Hr | g/Hr | | Vr/Q[a] | | |
| $(NH_4)_{1.5}$ $H_{0.5}SO_4$ | 650 | 24 | 120 | 375–190.5 | 79 | .29 | .11 |

[a]Vr = volume of reactor, liters. Q = flow rate, liters/minute.

Referring to the data in Table I, it can be seen that treatment with ammonium bisulfate or equal molar mixtures of ammonium sulfate-bisulfate, $(NH_4)_{1.5}$ $H_{0.5}$ $SO_4$, is an effective method of reducing the ash content of used oil to a level where it could be used as a furance oil or hydrotreated to a lube stock. Ammonium sulfate is less effective as a high hydrogen ion concentration is necessary to promote the metathesis reaction.

Variation in the temperature and contact time follow the expected trends, particularly when the lead content of the oil is used as a conversion index or efficiency of removal. Treatment for one hour at 375°F (190.5°C) reduces the lead content to 50 ppm using ammonium bisulfate. After 30 minutes the lead content is reduced to 90 ppm at 375°F. Reducing temperature from 375°F to 250°F (121°C) results in increasing lead content to 510 ppm. Varying the amount of water from 1 part water/3 parts of oil to 1 part water/12 parts of oil does not markedly alter the results.

It is apparent from the data of Table I that a low-ash treated oil could be prepared from this sample of used oil using the autoclave as a continuous well-stirred reactor. With feed rates of 650 ml/hour of used oil and 120 ml/hour of 20 weight percent mixture of ammonium sulfate and bisulfate solution, the treated oil product had an ash content of 0.29 weight percent and a lead content of 0.11 weight percent. These are close to the values one would expect for a first order rate of removal, and significantly lower ash and lead content would be expected from using two smaller reactors in series rather than one of equivalent volume.

A total of 8500 grams of oil was treated in a continuous manner with a mixture of ammonium sulfate and bisulfate solution of this ivention from which 8153 grams of treated oil was recovered along with 304 grams of dry solids. The material balance was 99.4 percent illustrating how efficiently the instant process can be operated.

Elemental analysis of the physical properties of the treated oil is given in Table II.

TABLE II

| Composition and Properties of Treated Oil | |
|---|---|
| Elemental Analysis, Wt. % | |
| C | 84.68 |
| H | 13.41 |
| O | 1.28 |
| N | .33 |
| S | .35 |
| | 100.05 |
| Ash, Sulfated | .29 |
| Pb | .11 |

TABLE II-continued

| Composition and Properties of Treated Oil | |
|---|---|
| Elemental Analysis, Wt. % | |
| Density, g/ml | .85 |
| Color | Black |

The solids settle rapidly in the spent ammonium sulfate solution and can be recovered by filtration. An elemental analysis of the dry exracted solids is given in Table III.

TABLE III

| Composition of Solids from Used Oil | |
|---|---|
| Dried at 110°C | Toluene Extracted Wt. % |
| Pb | 39.3 |
| Ba | .4 |
| Ca | 9.3 |
| Zn | 1.3 |
| $SiO_2$ | 1.6 |
| $Al_2O_3$ | .1 |
| $SO_4$ | 42.0 |
| | 94.0 |
| Unknown | 6.0 |
| | 100.0 |

A portion of the used lubricating oil treated as above was subjected to hydrotreating in order to produce a product that could be reused as lube stock. This was done using the hydrodesulfurization catalyst HDS-3 from American Cyanamide in a fixed bed reactor. This catalyst is available as a 1/16-inch × 3/16-inch extrudate and contains 3 percent Ni–15 percent Mo on $Al_2O_3$. The treated oil prior to hydrotreating was passed through a bed of silica to remove polar materials present in the oil and therefore minimize carry-over of polar material to the hydrotreating catalyst. The hydrotreating reactor was operated at conditions more or less typical for removal of sulfur and nitrogen compounds from cycle oils, specifically 1.3 LHSV, 680°F (360°C), 700 psig, and 1200 $ft^3$ of hydrogen/bbl of feedstock. Hydrogen consumption was 250–275 $ft^3$/bbl. The composition and properties of the final product are given in Table IV.

TABLE IV

| Composition and Properties of Finished Oil | |
|---|---|
| Elemental Analysis, Wt. % | |
| C | 85.94 |

TABLE IV-continued

| Composition and Properties of Finished Oil | |
|---|---|
| Elemental Analysis, Wt. % | |
| H | 13.82 |
| O | .02 |
| N | <0.2 |
| S | 0.01 |
| Carbon Residue | 0.05 |
| Sulfated Ash | <0.01 |
| API — Gravity | 31.6 |
| Viscosity — 100°F(37.8°C) | 214.9 SUS |
| 210°F(99°C) | 49.82 SUS |
| Viscosity Index | 128 |

I claim:

1. A process for reducing the ash content of used lubricating oils which comprises:

a. contacting used lubricating oil with an aqueous solution of ammonium sulfate and/or ammonium bisulfate under conditions of temperature and pressure sufficient to react said ammonium sulfate and/or ammonium bisulfate with metal-containing components present in the used lubricating oil and form metal-containing solids, b. allowing the reaction mass of (a) to separate into an oil phase and an aqueous phase containing said solids, and c. recovering the oil phase as a marketable low-ash oil product.

2. A process according to claim 1 wherein said aqueous solution is a mixture of ammonium sulfate and ammonium bisulfate.

3. A process according to claim 1 wherein said aqueous solution is approximately an equimolar mixture of ammonium sulfate and ammonium bisulfate.

4. A process according to claim 1 wherein the temperature is in the range of about 200°F to about 500°F (93°–260°C), the pressure is in the range of from atmospheric to about 750 psig, and the concentration of ammonium sulfate and/or ammonium bisulfate in the aqueous phase ranges from about 2 to about 25 weight percent.

5. A process according to claim 1 which additionally contains the step of d. contacting said oil phase recovered in (c) with an absorbent selected from activated clay, silica gel, and alumina under conditions sufficient to remove polar compounds including oxygen-, nitrogen-, and sulfur-containing compounds therefrom.

6. A process according to claim 5 which additionally contains the steps of e. subjecting said oil phase reduced in said polar compounds to hydrotreating in the presence of hydrogen and a hydrofining catalyst selected from nickel-molybdenum sulfide on alumina, cobalt molybdate, and tungsten-nickel sulfide on alumina under conditions including a temperature in the range of 500°F to 800°F (260°–427°C) sufficient to remove residual polar compounds and unsaturated compounds, and f. recovering as product the hydrotreated oil phase which is suited to use as a lube stock.

7. A process for reducing the lead content of used motor oil which comprises a. contacting said oil with an aqueous solution of ammonium sulfate and/or ammonium bisulfate reagent at conditions of temperature and pressure sufficient to react said ammonium sulfate with lead compounds present in the used motor oil, b. allowing the precipitate formed by the reaction to settle, and c. separting the oil from the water and solid precipitate.

8. A process according to claim 7 wherein the aqueous solution is a mixture of ammonium sulfate and ammonium bisulfate.

9. A process according to claim 7 wherein the reaction temperature is in the range of about 200°F to about 500°F (93°–260°C), the reaction pressure is in the range of about atmospheric to about 750 psig, and the concentration of ammonium sulfate in the aqueous reaction solution is about 2 to about 25 weight percent.

10. A process according to claim 7 comprising the additional steps of d. contacting said oil phase recovered in (c) with an absorbent selected from activated clay, silica gel, and alumina under conditions sufficient to remove polar compounds including oxygen-, nitrogen-, and sulfur-containing compounds therefrom, e. subjecting said oil phase reduced in polar compounds to hydrotreating in the presence of hydrogen and a hydrofining catalyst selected from nickel-molybdenum sulfide on alumina, cobalt molybdate, and tungsten-nickel sulfide on alumina under conditions including a temperature in the range 500° to 800°F (260°–427°C) sufficient to remove residual polar compounds and unsaturated compounds, and f. recovering as product the hydrotreated oil phase which is suited to use as a lube stock.

11. A process for reclaiming used motor oil containing metal salts which comprises a. preheating the used motor oil to a temperature in the range of about 200°F to about 500°F (93°–260°C), b. preheating an aqueous solution of ammonium sulfate and/or ammonium bisulfate to a temperature in the range of about 200°F to about 500°F (93°–260°C), c. contacting said preheated motor oil and said preheated aqueous solution of ammonium sulfate in at least one agitated reaction zone under conditions sufficient to maintain a reaction producing a precipitate, d. allowing the reaction product to separate into an oil layer and a water layer and the precipitate to settle in the water layer, e. removing the water layer and filtering the precipitate from the water, f. adding sufficient ammonium sulfate to the filtered water to produce an aqueous solution of ammonium sulfate and/or ammonium bisulfate having a concentration of about 2 to about 25 weight percent ammonium sulfate and recycle to step (b), and g. recovering the oil phase as a marketable low-ash oil product.

12. A process according to claim 11 which comprises the additional steps of h. contacting said oil phase recovered in (g) with an absorbent selected from activated clay, silica gel, and alumina under conditions sufficient to remove polar compounds including oxygen-, nitrogen-, and sulfur-containing compounds therefrom, i. subjecting said oil phase reduced in polar compounds to hydrotreating in the presence of hydrogen and a hydrofining catalyst selected from nickel-molybdenum sulfide on alumina, cobalt molybdate, and tungsten-nickel sulfide on alumina under conditions including a temperature in the range 500° to 800°F (260°–427°C) sufficient to remove residual polar compounds and unsaturated compounds, and j. recovering as product the hydrotreated oil phase which is suited to use as a lube stock.

* * * * *